United States Patent [19]

Svoboda et al.

[11] 4,272,099

[45] Jun. 9, 1981

[54] SKI BRAKE

[75] Inventors: Josef Svoboda, Schwechat; Erwin Krob, Vienna; Erwin Weigl, Brunn am Gebirge, all of Austria

[73] Assignee: TMC Corporation, Baar, Switzerland

[21] Appl. No.: 896,216

[22] Filed: Apr. 13, 1978

[30] Foreign Application Priority Data

Apr. 18, 1977 [AT] Austria ..... 2678/77

[51] Int. Cl.[3] ..... A63C 7/10

[52] U.S. Cl. ..... 280/605; 280/636

[58] Field of Search ..... 280/605, 604, 633, 636; 188/5

[56] References Cited

U.S. PATENT DOCUMENTS

| | | | |
|---|---|---|---|
| 3,992,030 | 11/1976 | Salomon | 280/605 |
| 4,012,057 | 3/1977 | Courvoisier | 280/605 |
| 4,036,509 | 7/1977 | Schwarz | 280/605 |
| 4,103,916 | 8/1978 | Krob et al. | 280/605 |
| 4,123,083 | 10/1978 | Riedel | 280/605 |

FOREIGN PATENT DOCUMENTS

| | | | |
|---|---|---|---|
| 2413099 | 10/1975 | Fed. Rep. of Germany | 280/605 |
| 2516985 | 4/1976 | Fed. Rep. of Germany | 280/633 |
| 2725184 | 3/1978 | Fed. Rep. of Germany | 280/605 |
| 2330419 | 6/1977 | France | 280/605 |

*Primary Examiner*—David M. Mitchell

*Attorney, Agent, or Firm*—Blanchard, Flynn, Thiel, Boutell & Tanis

[57] ABSTRACT

A ski brake for preventing the runaway of a ski following a release of the ski boot from engagement with the ski bindings on the ski. The ski brake includes a spring wire bar having a plurality of bends therein, one of the bends forming a stationary axle about which the entirety of the ski brake pivots. Another portion of the bar has a bend therein defining a movable axle. Both the stationary and the movable axles are mounted on a support plate. The position of the support plate relative to the ski binding component is selectively adjustable by a detent bar. As the ski brake is pivoted from the braking position wherein the braking mandrels project beneath the lower surface of the ski to a retracted position wherein the braking mandrels are located alongside the ski binding component, the movable axle is moved closer to the stationary axle to decrease the force required to hold the ski brake in the retracted position. Since the ski binding component can be mounted for movement along the longitudinal axis of the ski, any such movement will also effect a simultaneous movement of the support plate holding the ski brake because of the detent bar connection therebetween. Guide rails are provided for supporting both the support plate and the ski binding for movement along the longitudinal axis of the ski.

21 Claims, 11 Drawing Figures

Fig. 1
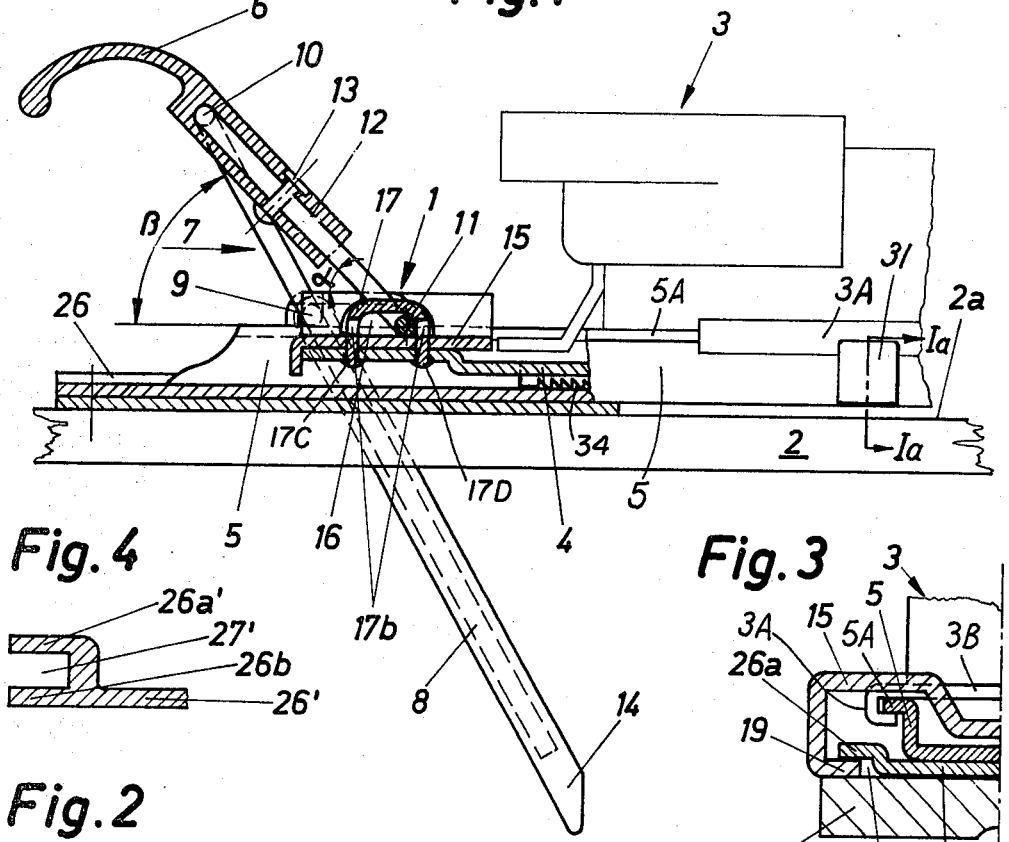
Fig. 4
Fig. 3
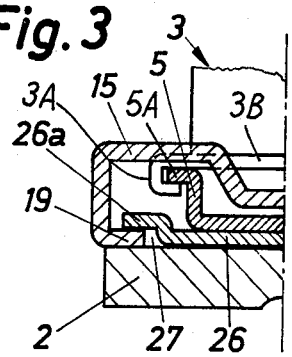
Fig. 2
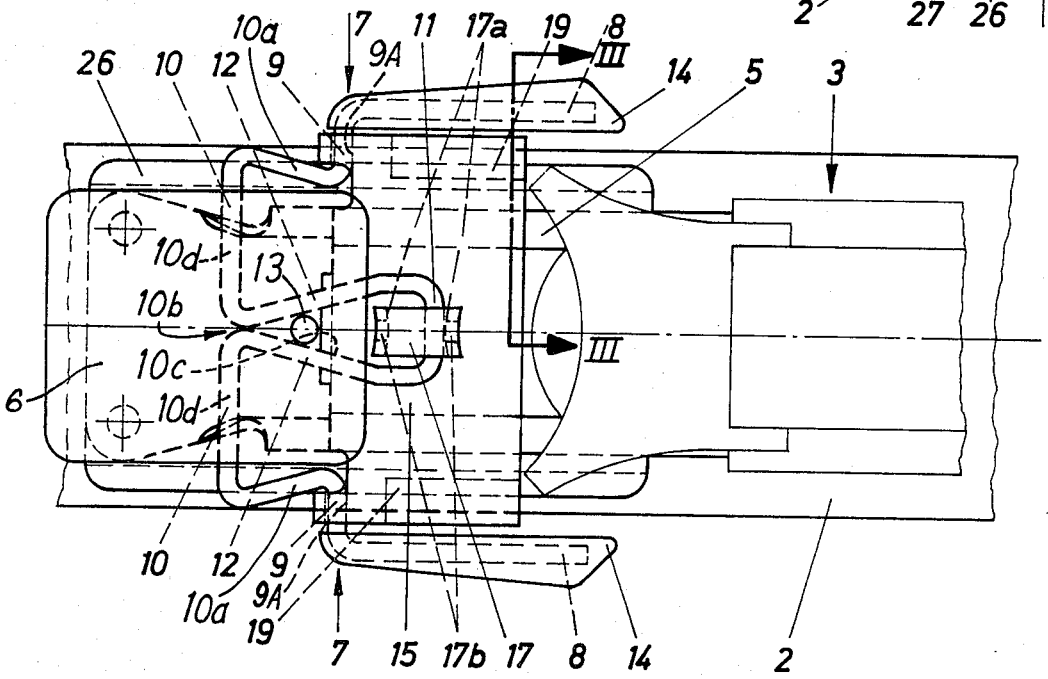
Fig. 1a
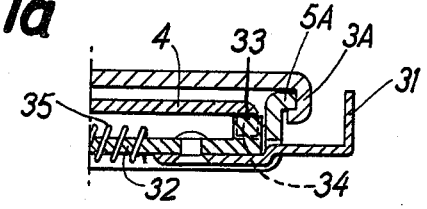

SKI BRAKE

FIELD OF THE INVENTION

The invention relates to a ski brake for preventing a running away of a ski following a release of same from a ski boot which is held on the ski by a ski binding. The ski brake includes a bar having braking mandrels which are located on both sides of the ski and are pivotally supported on the ski and designed from a multiply bent spring wire. The bar can be swung from a braking position, in which the braking mandrels extend downwardly, against a spring force into a retracted position, in which position it is held by the ski boot inserted into the ski binding by means of a stepping plate above the upper side of the ski. The bar is supported about two axes which are arranged spaced from one another in longitudinal direction of the ski, of which axes one is supported stationarily on the ski and the other is supported for movement in longitudinal direction of the ski, so that the spacing between the two axes decreases from the braking position toward the retracted position.

BACKGROUND OF THE INVENTION

Such ski brakes are known in various constructions. The ski brakes which concern more closely the above-mentioned subject matter are described approximately in German OS Nos. 24 12 623, 24 36 155, 25 07 371 and 25 31 466. All these constructions have in common the torsion-springlike design of the entire braking bar.

These known constructions have the disadvantage that the torsion force produced in the braking bar is the greatest in the retracted position of the ski brake, namely, when the ski boot is clamped in. This is disadvantageous for holding down the ski boot in the ski binding, since the ski binding with consideration of the erecting force, which acts onto the ski boot, must be adjusted accordingly. Very disadvantageous is the large holding force in ski brakes, which are arranged in the area of the front jaw, because these press directly on the ski boot which is supported on the clamp of the jaw and thus effect an additional friction, which make the release or the return force for centering the ski boot more difficult. Since the safety ski bindings must release the ski boot upon occurrence of outside forces of a certain magnitude, it can easily be understood that an additional no more neglectable force can cause interferences in the release operation.

A further construction is also described in the mentioned German OS No. 24 12 623, wherein the two bars are connected by means of an intermediate bar.

Therefore, in this known construction the torsion force is produced only in the stepping bar and in same also only by stretching, wherein the two bent sections of the bar are supported at the limit stop of a recess. The disadvantage of this known construction lies in the greatest force being again created in the retracted position and the torsion force also having to be produced by the stepping bar, so that again contrasting conditions must be fulfilled. A further disadvantage are the many parts which are needed to produce the erecting force of the braking bar.

A ski brake of the above-mentioned type is described in German OS No. 24 13 099. This construction does overcome the aforementioned disadvantages, however, it can be used only in individually (fix) mounted ski bindings in order to be able to hold the ski brake in the retracted position through forces which are neglectable for the release operation.

The objects of the invention are to provide an improved ski brake of the above-mentioned type such that same can be used also for ski rental purposes with all advantages.

The objects are achieved inventively by the braking bar being arranged on a plate which engages the bent sections of the spring wire of the braking bar and, arranged on both sides of the plate, are recesses in a ski-fixed support plate, which recesses extend in longitudinal direction of the ski, which support plate is secured to the ski preferably by means of a guide rail or a base plate, wherein both the plate and also a ski binding part (heel holder) with which the ski brake is associated are together longitudinally adjustable along the guide rail and selectively lockable in the respectively desired positions by an adjusting detent bar.

The inventive construction satisfactorily attains the set purpose, because through the constant adjustment of the ski brake to the respective position of the ski binding, which position is in reference to the longitudinal direction of the ski, the force required to hold the ski brake in the retracted position can be constantly small. Due to the inventive construction, this ski brake can be used in addition selectively as a jaw brake, heel brake or a universal brake, wherein the problemless stepping into the ski binding is not affected, by suitably arranging the stepping plate or the pedal.

BRIEF DESCRIPTION OF THE DRAWINGS

Further advantages and details of the inventive ski brake are described with reference to the drawings, which illustrate several exemplary embodiments.

In the drawings

FIGS. 1 to 4 illustrate a first exemplary embodiment, in which the braking mandrels are rotatably supported and the center part of the wire bar is movable in longitudinal direction of the ski, in association with a longitudinally adjustable rental ski binding, wherein FIG. 1 is a side elevational view in the braking position FIG. 2 is an associated top view, FIG. 3 is a cross-sectional view taken along the line III-III of FIG. 2 and FIG. 4 is a modification of FIG. 3;

FIG. 1*a* is a fragmentary sectional view taken along the line I*a*—I*a* in FIG. 1;

FIG. 1*b* is a perspective view of the U-shaped connecting member;

FIGS. 7 and 8 illustrate a third exemplary embodiment with an additional operating pedal, wherein FIG. 7 is a side elevational view in the braking position and FIG. 8 is a top view in the retracted position.

DETAILED DESCRIPTION

Figure 5:
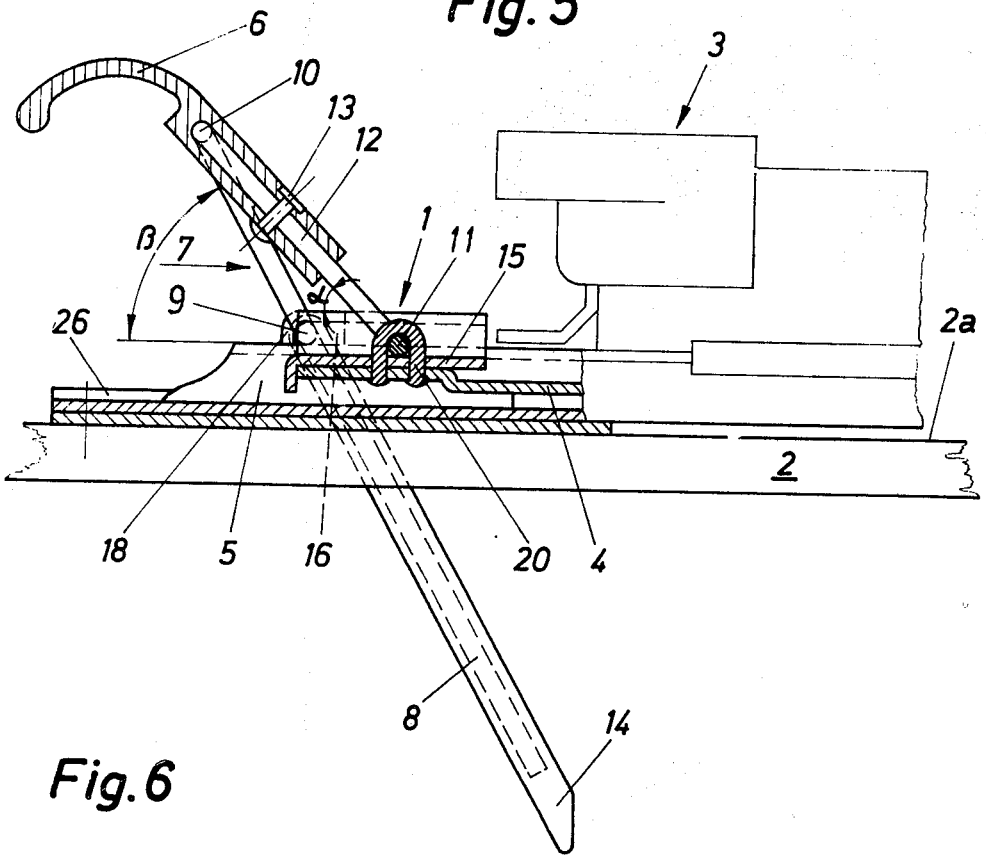
FIGS. 5 and 6 illustrate a second exemplary embodiment similar to FIGS. 1 and 2, however, with an interchange of the stationarily and slidingly arranged axes.

Corresponding parts will be identified with the same reference numerals in the following description; parts which have the same function, however, and are designed differently, will be identified with the prime (') suffix added to the reference numeral.

In the first exemplary embodiment according to FIGS. 1 to 4, the ski brake which is identified as a whole by reference numeral 1 is mounted on a mounting plate 15. The lateral edges 19 of the plate 15 grip, as can better be seen from FIG. 3, under the lateral edges 26*a* of a support plate 26 secured to the ski through a guide rail or base plate 5. According to FIG. 3, the support plate 26 has on both sides upwardly projecting and laterally projecting bent sections 26*a*, which define recesses 27 therebeneath with the upper side 2*a* of the ski. The recesses 27 form a sort of a guideway for the bent sections 19 of the plate 15. According to FIG. 4, the recesses 27' are formed by extensions 26'*a*, 26*b* of a modified support plate 26'. A ski binding part, which is constructed as a heel holder 3 and which is not the subject matter of the present invention, has lateral edges 3A on a support plate 3B thereof gripping around the lateral edges 5A of the guide rail 5 so that it is longitudinally movably arranged relative to the guide rail 5 and is releasably lockably arranged in positions which correspond with the desired sizes of the ski boot. The ski brake 1 is connected by means of a locking detent 4 to the heel holder 3 in a manner which will be discussed hereinbelow. Therefore, during an adjustment of the heel holder 3, the ski brake is also adjusted. The front ski binding part is not shown and same may have any desired, actually also known construction. FIGS. 1 and 2 illustrate the ski brake 1 in the braking position and the ski boot, which moves the ski brake 1 into the ready or retracted position by stepping down on a stepping plate 6, was purposefully omitted for a better understanding. The braking bar 7 of the ski brake 1 consists of one single spring steel wire which extends above the upper side 2*a* of the ski and on both lateral sides of the ski 2 and has several bent sections and has braking mandrels 14 at its ends or arms 8. The mandrels in this embodiment are plastic covers which are provided on the wire ends 8.

The braking bar 7 is generally U-shaped (see FIG. 2) with the legs of the U defining the wire ends 8 on which the aforesaid mandrels are mounted. Intermediate the wire ends 8 and the bight portion 10 a bend is provided so that a pair of axles 9 is defined which extends perpendicularly to the longitudinal axis of the ski and generally to the longitudinal axes of the wire ends 8 and the sections of wire 10*a* extending between the axles 9 and the bight portion 10. FIG. 3 shows less than a 90° angular relationship between the wire sections 10*a* and the axles 9. The bight portion 10 has an integral U-shaped central section 10*b* opening in the opposite direction as the U-shaped braking bar 7 and having legs 12 and a connecting bight portion 11 extending parallel to the axles 9 and itself defining an axle. In this particular embodiment, the legs 12 at their juncture with the wire section 10*d* of the bight 10 which extends parallel with the axles 9 and 11 are in contact with each other so that the legs 12 and the axle 11 define a generally triangular shaped opening 10*c* wherein the axle 11 defines the base of the triangle. The wire segment 8 and the bight portion 10 are coplanar. The legs 12 and bight portion 11 are also coplanar and in a plane which is at an acute angle to the plane of the wire segments 8 and bight portion 10.

The plate 15 has a pair of laterally spaced and axially aligned openings 9A therein receiving the axles 9 therethrough to rotatably support the axles 9. Intermediate the openings 9A and spaced rearwardly therefrom, an inverted U-shaped connecting member 17 is secured to the plate 15 to define a guide 16. The legs 17C and 17D of the member 17 are spaced from each other along the longitudinal axis of the ski a distance greater than the wire diameter of the axle 11 and slidingly receives the axle 11 therebetween. The legs 17C and 17D of the member 17 have arcuate surface profiles 17*a* to prevent the guide from becoming plugged with snow or ice. Openings 17*b* can be provided in the legs 17C and 17D to facilitate the removal of the snow. A stepping plate 6 is secured to the bight portion 10 and the legs 12 of the U-shaped central section 10*b* by means of rivets 13. The rivet 13 extends between the legs 12 of the central U-shaped section as shown in FIG. 2. Since the stepping plate forms an acute angle $\alpha$ with the plate 15, stepping into the ski binding 3 is made easier.

The legs 17C and 17D of the member 17 are also secured to the elongated detent bar 4 which extends to and is adjustably connected to the guide rail 5. The relative spacing between a slide bar 31 on the guide rail 5 and the plate 15 and thence the braking bar 7 is adjustable by moving the detent bar 4 relative to the slide bar 31. This is accomplishable with the structure shown in FIG. 1*a*. The slide bar 31 is slidably supported on the guide rail 5 for movement in a direction transver of the longitudinal direction of the ski. The slide bar 31 has a toothed rail part 32 thereof the teeth 33 of which engage the teeth 34 on the detent bar 4. Thus, a movement of the slide bar 31 to the left in FIG. 1*a* will release the engagement between the teeth 33, 34 to facilitate a relative movement between the detent bar 4 and the slide bar 31. The spring 35 will effect a return of the slide bar 31 and a re-engagement of the teeth 33, 34 upon a release of the manual pressure applied to the slide bar 31. A similar type structure is shown in U.S. Pat. No. 4,022,493.

The longitudinal length of the recesses 27 (FIG. 3) or 27' (FIG. 4) in the support plate 26 or 26' is dimensioned such that the plate 15 has an adjusting range which is as long as the adjusting range of the heel holder 3 on the guide rail 5. The guide rail 5 and the recesses 27, 27' are thereby offset against one another in longitudinal direction of the ski by the spacing which exists between the heel holder 3 and the plate 15.

OPERATION

This ski brake operates as follows: By pressing down the stepping plate 6 with the ski boot (not shown), the ski brake is moved into the retracted position against the torsional force generated in the bight portion 10, particularly the sections 10*d* thereof, and the sliding axle 11 moves along the guide 16 and reduces the force urging the braking bar 7 to the braking position due to a reduction of the spacing along the longitudinal axis of the ski between the axles 9, 11, which assures a breakdown-free function of the ski binding. Since the plate 15 is fixedly connected to the heel holder 3 through the U-shaped member 17 and by means of the adjustable detent bar 4, the spacing between the heel holder and the pedal or stepping plate 6 is maintained constant independent from the size of the ski boot which is used, since the ski brake 1 and the heel holder 3 are adjusted together on the guide rail 5 and the support plate 26.

Figure 6:
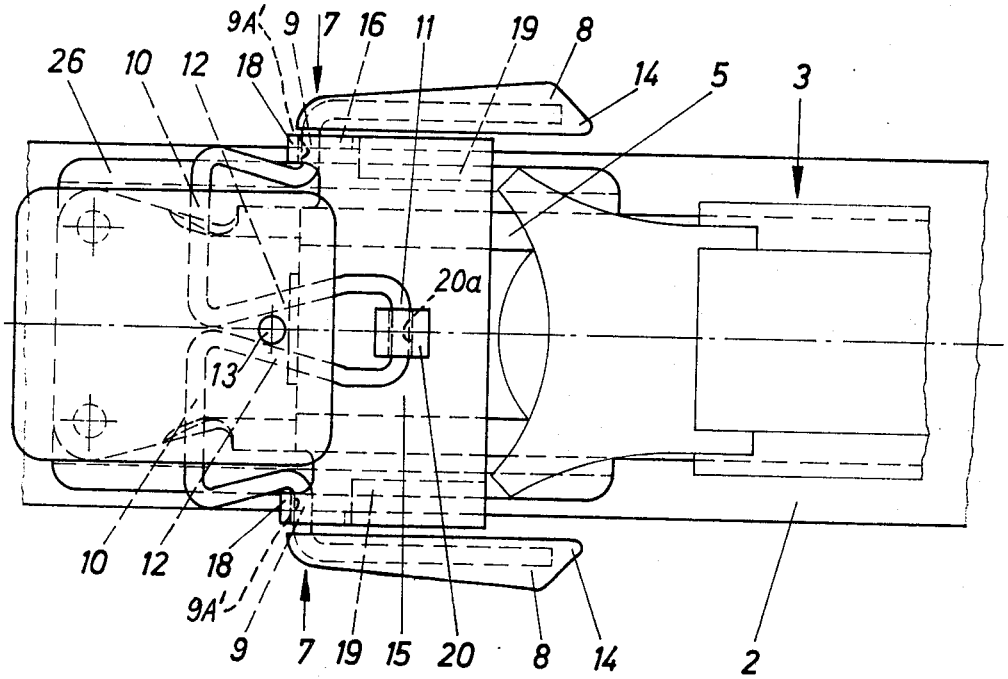

SECOND EMBODIMENT (FIGS. 5 and 6)

In the second exemplary embodiment according to FIGS. 5 and 6, the difference from the first embodiment lies in the axle 11 being stationarily mounted on the plate 15' and the two outer axles 9 are supported for movement with respect to the plate 15'. The construction of the braking bar 7 is otherwise unchanged. The necessary slotlike openings 9A' in the plate 15' are constructed by bent sections 18 of the plate 15'. In this case the braking bar 7 with the plate 15' and the adjusting detent bar 4 are connected together by an inverted U-shaped member 20 forming the stationary support for the axle 11.

OPERATION OF SECOND EMBODIMENT

This embodiment operates as follows: By pressing down the stepping plate 6 with the ski boot (not illustrated), the ski brake is moved into the retracted position and the braking bar 7 rotates about the stationary axle 11 and its outer axles 9 slide along in the slotlike openings 9A'. In this embodiment, the point of contact of the stepping plate 6 lies closer in the retracted position to the ski boot heel than in the embodiment according to the first embodiment of FIGS. 1 to 3, because the sliding axle 9 moves in direction toward the heel holder 3. The length adjustment is similar as in the first embodiment. The member 20 can also have profiled snow and/or ice ejecting surfaces **20*a***.

Figure 7:
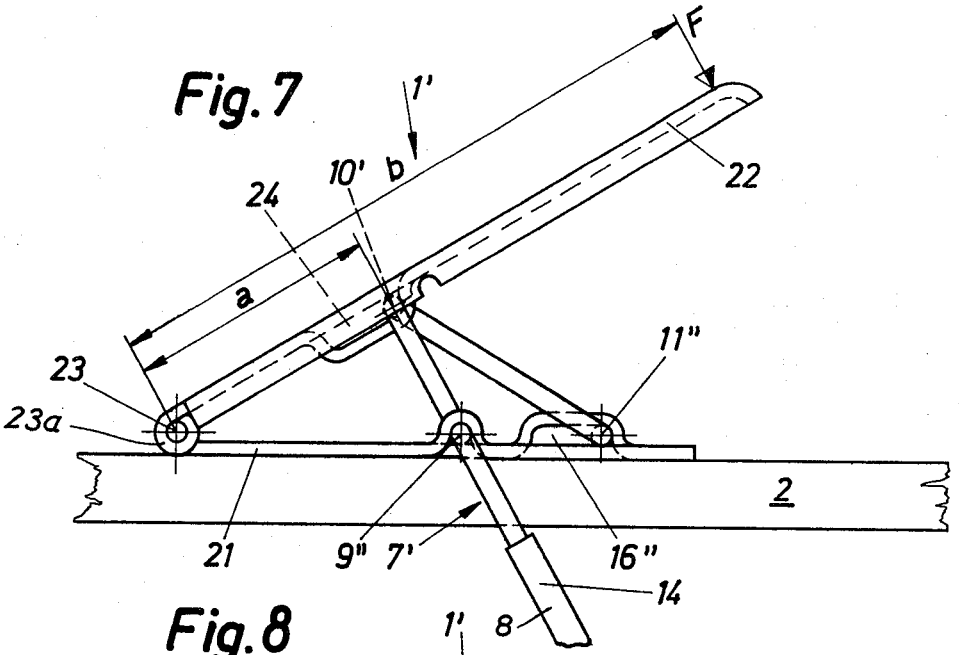
Figure 8:
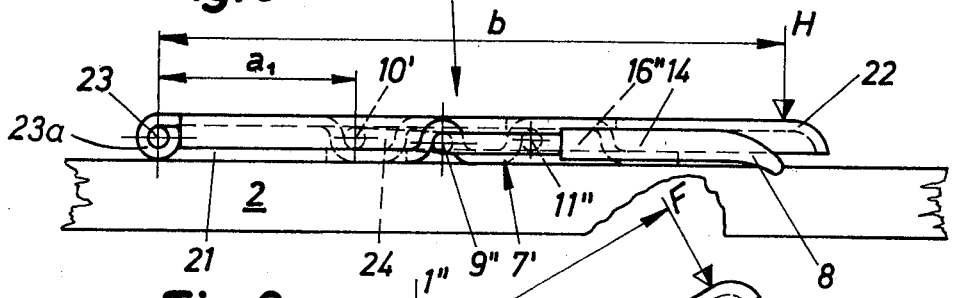

THIRD EMBODIMENT (FIGS. 7 and 8)

In the case of the third exemplary embodiment according to FIGS. 7 and 8, the structure of the ski brake 1' is similar to the first exemplary embodiment, wherein FIG. 7 is a side elevational view in the braking position and FIG. 8 is a side elevational view in the retracted position. The dimensions of the braking bar 7' are thereby shorter than in the preceding examples in order to arrange said bar closer on a bearing 23 which will be described hereinbelow. The braking bar 7' is supported on a base plate 21, which is held on the ski 2 either directly or indirectly through a ski binding which is not illustrated. A pedal 22 which operates the braking bar 7' is rotatably supported about an axle 23 which lies in a bearing **23*a* extending substantially at a right angle to the longitudinal axis of the ski and spaced from the stationary axle 9'' of the braking bar 7' and the bight portion 10' of the braking bar 7' moves under the action of the operating force F in a guideway 24 on the pedal 22. In addition, the axle 11'' slides in a guideway 16'' provided on the base plate 21. This exemplary embodiment is suited particularly for the jaw ski brakes, since the operating force F is being reduced in the relationship of the lever arms a:b. The holding force H in the retracted position (FIG. 8) of the ski brake 1' is particularly small, because the lever arm $a_1$ can be chosen to be very small. A further advantage of this embodiment consists in the pedal 22** assuming the natural angle of the ski boot during a stepping into the ski binding.

FOURTH EMBODIMENT (FIG. 9)

Figure 9:
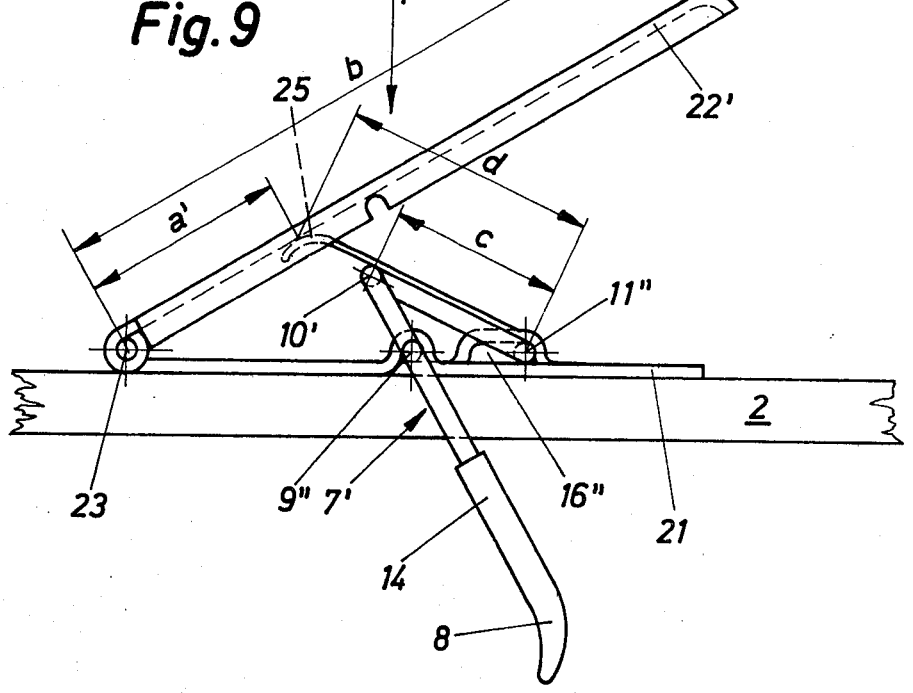
FIG. 9 illustrates a fourth exemplary embodiment similar to FIGS. 5 and 6 with an intermediate lever, wherein the braking position is illustrated in a side elevational view.

In the fourth exemplary embodiment according to FIG. 9, the structure is similar to the third exemplary embodiment, wherein the braking bar 7' is operated by the pedal 22' by the interpositioning of an intermediate lever 25. This arrangement permits particularly small operating or holding forces F and H because the relationship of the lever arms a':b' or c:d reduce correspondingly the force acting onto the ski boot.

The invention is not limited to the listed exemplary embodiments. A number of modifications are possible, without departing from the scope of the invention. It is for example conceivable to arrange the braking mandrels so that they face in an opposite direction or to secure the entire ski brake so that it can be pivoted at 180° on the ski. Furthermore, it is conceivable to vary the length of the lever arms or to select a different position of the intermediate lever.

For the purpose of reducing the resistance during the adjustment, the bent sections 26 or extensions **26'*a*, 26*b*, which define the recesses 27, 27', can have inserts made of a low friction material, or the material defining the recesses 27, 27'** can at least consist of such a material or can be coated with such a material. Such measures can also be taken in other sliding or bearing areas. The exemplary embodiments show the inventive ski brake in connection with a heel holder. The ski brake can also be used with the same success in connection with a ski binding part, which is constructed as a front jaw, as this has already been pointed out. If desired, the support plate which is needed for holding and adjusting the plate on the ski is mounted on the ski independent from the guide rail of the ski binding part. It is also conceivable to vary the described embodiments among one another.

To reduce the stepping-in angle ($\alpha$), the stepping plate 6 is mounted directly on the center part 12 of the braking bar 7 or is fixedly connected to same. This permits a stepping in also with boots having a soft sole, namely, with boots which have a large friction coefficient between the boot and the stepping plate (compare the smaller angle $\alpha$ with respect to the larger angle $\beta$ in FIGS. 1 and 5).

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A support structure for mounting a ski brake on a ski adjacent to a safety ski binding means also mounted on said ski, comprising:

guide rail means secured to said ski and extending coextensively therewith, said safety ski binding means being mounted on said guide rail means and having an elongated detent bar separate from said guide rail means extending forwardly therefrom;

a mounting plate having axle receiving means thereon, said axle receiving means including second means for effecting a securement of said mounting plate to the forward end of said detent bar; and spring wire ski brake means having axle segments received in said axle receiving means, including said second means on said mounting plate for pivotally supporting said ski brake for movement between an operative position and an inoperative position thereof.

2. The support structure according to claim 1, wherein said ski binding means includes adjustment means for effecting a selective adjustment of the position of said ski binding means and said detent bar relative to said guide rail means.

3. The support structure according to claim 1, wherein said axle receiving means includes means defining a first axle receiving opening and wherein said second means includes means defining a second axle receiving opening spaced longitudinally along the longitudinal axis of said ski; and wherein said ski brake means includes first and second axle segments received, respectively, in said first and second axle receiving openings, the axes of said first and second axle segments extending perpendicular to said longitudinal axis of said ski.

4. The support structure according to claim 3, wherein said first axle opening fixedly locates said first axle segment relative to said mounting plate;

wherein said second axle opening is elongated in the direction of said longitudinal axis of said ski to facilitate a sliding movement of said second axle segment therein;

wherein said spring wire ski brake means includes a U-shaped braking bar having a pair of brake arms located along opposite side edges of said ski interconnected by a first bight portion, each of said brake arms having said first axle segment therein, said first bight portion including an integral U-shaped central segment opening outwardly in a direction opposite to the opening of said U-shaped braking bar, said U-shaped central segment having a second bight portion defining said second axle segment, said U-shaped central segment and said U-shaped braking bar being contained in separte planes, said U-shaped central segment being contained in a plane which is oriented at an acute angle to the plane of said U-shaped braking bar.

5. The support structure according to claim 4, wherein said second means comprises a U-shaped connecting member having first and second legs and an interconnecting bight portion, the spacing between said first and second legs being sufficient to permit movement of said second axle segment relative to said mounting plate, said mounting plate and said detent bar having aligned openings therein receiving said first and second legs of said U-shaped connecting member therein, enlargement means on the free ends of said first and second legs to prevent removal thereof from said aligned openings and to effect said securement of said detent bar to said mounting plate.

6. The support structure according to claim 5, wherein said first and second legs of said U-shaped connecting member have opposed surfaces with deflecting means for ejecting snow, ice and the like therefrom in response to movement of said second axle segment therebetween.

7. The support structure according to claim 5, wherein at least one of said surfaces has means defining an opening therethrough to facilitate the removal of snow, ice and the like from said surface.

8. The support structure according to claim 7, wherein said opening is provided in the leg of said U-shaped connecting member closest the tail end of said ski.

9. The support structure according to claim 7, wherein each of said first and second legs has means defining an opening therethrough to facilitate the removal of snow, ice and the like from said surface.

10. The support structure according to claim 6, wherein said deflecting means includes an inwardly arcuate surface contour on each of said first and second legs and opposing each other.

11. The support structure according to claim 3, wherein said second axle opening fixedly locates said second axle segment relative to said mounting plate;

wherein said first axle opening is elongated in the direction of said longitudinal axis of said ski to facilitate a sliding movement of said first axle segment therein;

wherein said spring wire ski brake means includes a U-shaped braking bar having a pair of brake arms located along opposite side edges of said ski interconnected by a first bight portion, each of said brake arms having said first axle segment therein, said first bight portion including an integral U-shaped central segment opening outwardly in a direction opposite to the opening of said U-shaped braking bar, said U-shaped central segment having a second bight portion defining said second axle segment, said U-shaped central segment and said U-shaped braking bar being contained in separate planes, said U-shaped central segment being contained in a plane which is oriented at an acute angle to the plane of said U-shaped braking bar.

12. The support structure according to claim 11, wherein said second means comprises a U-shaped connecting member having first and second legs and an interconnecting bight portion, the spacing between said first and second legs preventing movement of said second axle segment relative to said mounting plate, said mounting plate and said detent bar having aligned openings therein receiving said first and second legs of said U-shaped connecting member therein, enlargement means on the free ends of said first and second legs to prevent removal thereof from said aligned openings and to effect said securement of said detent bar to said mounting plate.

13. A support structure for mounting a ski brake on a ski adjacent to a safety ski binding means also mounted on said ski, comprising:

guide rail means fixedly secured to said ski and extending coextensively therewith and parallel to the longitudinal axis of said ski, said safety ski binding means being mounted on said guide rail means and having an elongated detent bar separate from said guide rail means extending forwardly therefrom;

a support plate, separate from said guide rail means and said detent bar, fixedly mounted on said ski and extending coextensively with said ski, and support plate having first guide means thereon extending parallel to said longitudinal axis of said ski;

a mounting plate having said ski brake mounted thereon and having second guide means thereon mounted on said first guide means of said support plate;

connecting means for connecting said mounting plate to the forward end of said detent bar; and adjustment means on said safety ski binding means for effecting a selective simultaneous adjustment of the position of said mounting plate and said safety ski binding means relative to said mounting plate and said guide rail means, respectively.

14. The support structure according to claim 13, wherein said first guide means is defined by a segment of the lateral edge portions of said support plate being vertically spaced above the upper surface of said ski and lying in a plane generally parallel to the upper surface of said ski; and wherein said second guide means is defined by a segment of the lateral edge portions of said mounting plate being bent into the form of an L having a first leg extending generally perpendicular to the upper surface of said ski and a second leg extending generally parallel to the upper surface of said ski and being received in the spacing between said lateral edge portions of said support plate and the upper surface of said ski.

15. The support structure according to claim 13, wherein said first guide means is defined by a segment of the lateral edge portions of said support plate being formed into a laterally opening U;

wherein said second guide means is defined by a segment of the lateral edge portions of said mounting plate being bent into the form of an L having a first leg extending generally perpendicular to the upper surface of said ski and a second leg extending generally parallel to the upper surface of said ski and being received in the spacing between the legs of said laterally opening U construction.

16. The support structure according to claim 13, wherein said support plate is arranged at one end of said guide rail means and extends in longitudinal alignment therewith; and wherein the length of said first guide means is at least as long as the length of said guide rail means.

17. A support structure for mounting a ski brake on a ski adjacent to a safety ski binding means also mounted on said ski, comprising:

a mounting plate mounted on said ski and having means defining first and second axle receiving openings thereon spaced along the longitudinal axis of said ski;

a U-shaped, spring wire ski brake means having a pair of brake arms located along opposite side edges of said ski interconnected by a first bight portion, each of said brake arms having a first axle segment therein received in said first axle receiving opening, said first bight portion including an integral U-shaped central segment opening outwardly in a direction opposite to the opening of said U-shaped braking bar, said U-shaped central segment having a second bight portion defining a second axle segment received in said second axle receiving opening, said first and second axle segments supporting said ski brake means for pivotal movement between a braking position wherein said brake arms extend at a transverse angle to the bottom surface of said ski and a retracted position wherein said brake arms extend generally parallel to the upper surface of said ski, said first and second axle segments extending perpendicular to the longitudinal axis of said ski, one of said first and second axle openings fixedly locating one of said first and second axle segments, the other of said first and second axle openings being elongated in the direction of said longitudinal axis of said ski to facilitate a sliding movement of said one of said first and second axle segments, said U-shaped central segment having a pair of legs each extending from an end of said second axle segment on opposite sides of said second axle receiving opening toward each other so that an opening is defined by said legs and said second axle segment; and a stepping plate mounted on said U-shaped central segment and fixedly connected thereto by means of a fastening element extending through said opening.

18. The support structure according to claim 17, wherein said opening is triangular in shape.

19. The support structure according to claim 17, wherein said U-shaped central segment and said U-shaped braking bar are contained in separate planes, said U-shaped central segment being contained in a first plane which is oriented at an acute angle to a second plane containing said U-shaped braking bar.

20. The support structure according to claim 19, wherein said mounting plate has a mounting surface; and wherein said first plane is oriented at a first acute angle to said mounting surface which is less than a second acute angle at which said second plane extends relative to said mounting surface when said brake arms are in said braking position.

21. The support structure according to claim 20, wherein said mounting surface is parallel to the upper surface of said ski.

* * * * *

UNITED STATES PATENT AND TRADEMARK OFFICE

CERTIFICATE OF CORRECTION

PATENT NO. : 4 272 099

DATED : June 9, 1981

INVENTOR(S) : Josef Svoboda, Erwin Krob and Erwin Weigl

It is certified that error appears in the above—identified patent and that said Letters Patent is hereby corrected as shown below:

Col. 7, line 26; change "separte" to ---separate---.

Col. 8, line 44; change "and support" to ---said support---.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*